US007581849B2

(12) United States Patent
Mock

(10) Patent No.: US 7,581,849 B2
(45) Date of Patent: Sep. 1, 2009

(54) DIGITAL PICTURE DISPLAY ORNAMENT WITH LEDS

(76) Inventor: Jason Mock, P.O. Box 120961, Clermont, FL (US) 34712

( * ) Notice: Subject to any disclaimer, the term of this patent is extended or adjusted under 35 U.S.C. 154(b) by 34 days.

(21) Appl. No.: 11/953,462

(22) Filed: Dec. 10, 2007

(65) Prior Publication Data

US 2008/0199639 A1 Aug. 21, 2008

Related U.S. Application Data

(60) Provisional application No. 60/890,896, filed on Feb. 21, 2007.

(51) Int. Cl.
*F21V 33/00* (2006.01)

(52) U.S. Cl. ..... 362/234; 362/249.01; 362/253; 362/458; 362/806; 40/714; 40/737

(58) Field of Classification Search ..... 362/234, 362/249, 253, 458, 806, 249.01; 345/46, 345/48, 50, 87; 40/406, 541, 544, 549, 564, 40/700, 714–716, 737

See application file for complete search history.

(56) References Cited

U.S. PATENT DOCUMENTS

2005/0057578 A1 * 3/2005 Chen et al. ..... 345/630

* cited by examiner

*Primary Examiner*—Jason Moon Han
(74) *Attorney, Agent, or Firm*—McKinney Law, PLLC

(57) ABSTRACT

A digital picture display ornament comprising a transparent exterior housing and an opaque internal casing. The exterior housing includes a front circular face with an annular sidewall extending rearward from the periphery of the front circular face. The internal casing slips within the exterior housing. Multiple user interface controls are provided on the ornament to control the microprocessor of the ornament and for downloading digital pictures to the ornament. LEDs are disposed on a rear surface of the transparent front face of the exterior housing to illuminate graphic elements of a decorative sheet secured to the front face of the exterior housing. The internal casing has a multiple LED notches disposed in an outer sidewall adapted for receiving a LED. The secondary LEDs illuminate outwards from the internal casing through the transparent sidewall of the exterior housing to produce a glow to the periphery of the ornament.

20 Claims, 4 Drawing Sheets

DIGITAL PICTURE DISPLAY ORNAMENT WITH LEDS

CROSS-REFERENCE TO RELATED APPLICATIONS

This application claims the benefit of U.S. Provisional Application No. 60/890,896 filed Feb. 21, 2007. The disclosure of the provisional application is incorporated herein by reference.

BACKGROUND OF THE INVENTION

1. Field of the Invention

The present invention relates generally to ornaments, and more specifically to an ornament in which a plurality of light emitting diodes are disposed about a digital picture display to create special lighting effects to capture a user's attention.

2. Description of the Prior Art

Digital cameras have become the preferred choice for a large number of consumers due in part to the convenience of not being required to purchase and develop photographic film. Most digital cameras employ a charge coupled device, which includes a large number of diodes called pixels that convert photons into electrons. An electrical charge is accumulated by each pixel as it receives light and determines the intensity of the light. Various methods of using red, blue and green filters produce the full color image. The digital camera captures images and stores pictures in non-volatile memory using techniques well known in the field. The digital images can be downloaded to a computer using a serial, parallel, SCSI or universal serial bus port. Removable memory is also common in digital cameras in addition to using floppy disks or writeable CDs.

There have been attempts to develop devices other than computers or printers that are capable of receiving and displaying digital pictures. By way of example, note U.S. Pat. No. 6,975,308 to Bietto that discloses a picture frame for displaying digital images taken by a digital camera. The frame of Bietto may be a wall mounted frame or desk top frame and displays digital pictures when a motion sensor of the frame is activated. A shortcoming of this prior art is that the frame is a conventional type frame and is not adaptable to accentuate the digital images being displayed using specialized lighting effects.

Another example is U.S. Pat. No. 4,754,271 to Edwards that discloses a liquid crystal display for viewing digitally encoded pictures. The display of Edwards is described as approximately one-sixteenth of an inch in thickness and small enough to fit in a shirt pocket. Similar to the shortcomings of Bietto, the display does not accentuate the digital image being displayed. Accordingly, what is needed in the art is a more elaborate device for displaying digital images that captures the user's attention.

Another need exists in the art for an improved digital picture display that is customized to coordinate to a particular time of year or holiday.

Another need exists in the art for an improved digital picture display that is readily adaptable to suspend from a Christmas tree limb as an ornament.

Another need exists in the art for an improved digital picture display that is adaptable to display digital images stored and formatted as either JPEG, bmp, png, or gif files.

Another need exists in the art for an improved digital picture display that can be powered by connecting to a string of lights using a vacated light bulb socket.

It is, therefore, to the effective resolution of the aforementioned problems and shortcomings of the prior art that the present invention is directed.

However, in view of the prior art at the time the present invention was made, it was not obvious to those of ordinary skill in the pertinent art how the identified needs could be fulfilled.

SUMMARY OF THE INVENTION

This invention is a digital picture display ornament comprising an exterior housing of a transparent material and an opaque internal casing. The exterior housing includes a front circular face with an annular sidewall extending rearward from the periphery of the front circular face. A rectangular boss is disposed concentrically on the rear surface of the front face to secure a liquid crystal display ("LCD"). The LCD screen is in electrical communication with electronics stored within the ornament. The internal casing is removably slipped snugly within the exterior housing with a friction fit. The rear surface of internal casing includes multiple user interface controls so that the user can activate and control the microprocessor of the ornament and to download digital pictures to non-volatile memory within the internal casing. A plurality of primary light emitting diodes ("LED") are disposed on the rear surface of the transparent front face of the exterior housing. The primary LEDs are disposed and orientated such that when illuminated the primary LEDs illuminate graphic elements of a decorative sheet secured to the front face of the exterior housing. The periphery of the internal casing includes a pair of concentric sidewalls wherein a plurality of secondary LEDs are housed therein. The internal casing has a plurality of notches disposed in the outer sidewall of the pair of concentric sidewalls for receiving the secondary LEDs. The outer sidewall of the internal casing slides adjacent to the transparent sidewall of the external housing so that the secondary LEDs illuminate outwards from the internal casing and produce a glow to the periphery of the ornament.

It is therefore a primary object of the invention to provide a more elaborate device for displaying digital images that captures the user's attention.

Another object of the present invention is to provide an improved digital picture display that is customized to coordinate to a particular time of year or holiday.

Another object of the present invention is to provide an improved digital picture display that is readily adaptable to suspend from a Christmas tree limb as an ornament.

Another object of the present invention is to provide an improved digital picture display that is adaptable to display digital images stored and formatted as either JPEG, bmp, png, or gif files.

Another object of the present invention is to provide an improved digital picture display that can be powered by connecting to a string of lights using a vacated light bulb socket.

These and other important objects, advantages, and features of the invention will become clear as this description proceeds.

The present invention, accordingly, comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
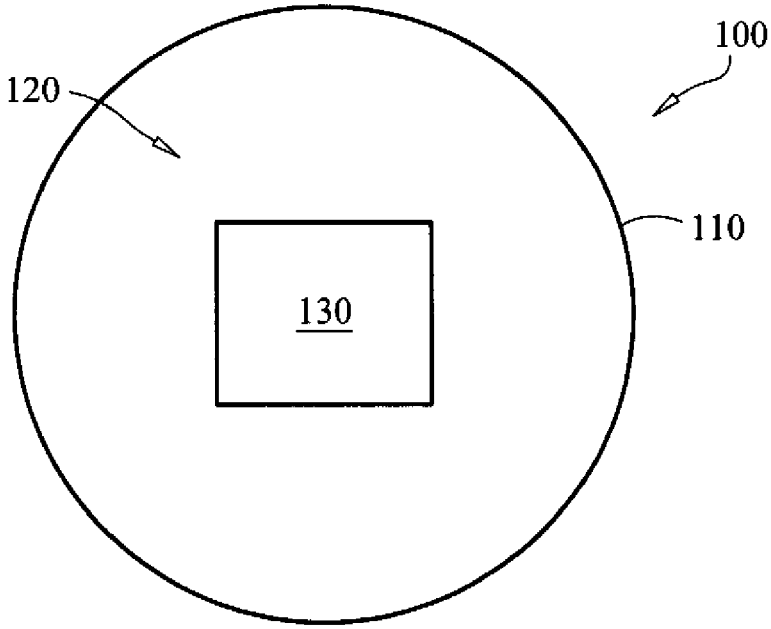
FIG. 1 is a front view of the digital display ornament showing an embodiment of the present invention.

Referring now to FIG. 1, shows the front of digital picture display ornament 100. Ornament 100 is generally cylindrical in shape including an exterior housing 110 having a front circular face 120 for receiving a decorative sheet as explained below. A sidewall extends rearward from the periphery of front circular face 120 forming a void to house the internal casing of ornament 100 within exterior housing 110. Both the sidewall of ornament 100 and front face 120 are completely comprised of a rigid transparent material such as polyethylene as will be explained below. A rectangular boss disposed concentrically on the rear surface of front face 120 allows a liquid crystal display ("LCD") 130 to be firmly secured therein so that LCD screen 130 does not move but is viewable through a front surface of the completely transparent front face 120. LCD screen 130 is in electrical communication with electronics stored within the internal casing of ornament 100.

Figure 2:
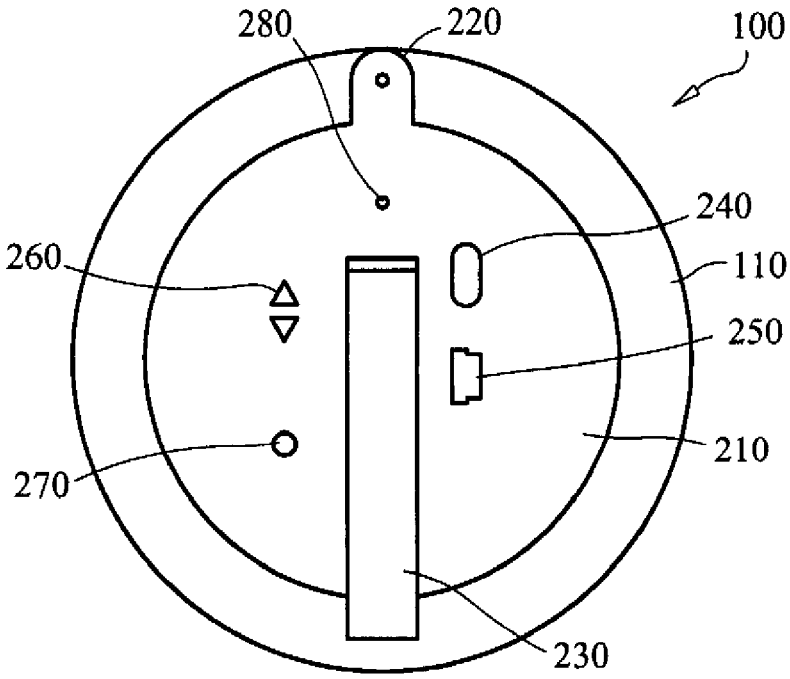
FIG. 2 is a rear view of the digital display ornament showing an embodiment of the present invention.

The rear of ornament 100 is visible in FIG. 2, which shows the thickness of the sidewall of exterior housing 110 extending rearward from the periphery of front face 120. Internal casing 210 includes a rear circular face having a sidewall extending from the periphery forming a void to house various electronic elements for ornament 100. Internal casing 210 is removably slipped snugly within exterior housing 110 with a friction fit. A rounded protrusion 220 is disposed at a top portion of internal casing 210 for hanging ornament 100 from a tree limb or nail, for example. The sidewall of exterior housing 110 includes a reciprocal aperture orientated to receive rounded protrusion 210 completely therein so that exterior housing 110 has a smooth circular appearance along the periphery.

A retractable leg stand 230 is pivotally mounted to the rear surface of internal casing 210. Leg stand 230 swings outwardly from a stored position of internal casing 210 to an angled position with a first end resting on a flat surface (not shown). A second end of leg stand 230 is hingedly mounted to the ornament 100 such that ornament 100 is supported in an upright position so that LCD screen 130 is easily viewable. The sidewall of exterior housing 110 includes a reciprocal aperture orientated to receive the first end of leg stand 230 when leg stand 230 is in a stored position.

The rear surface of internal casing 210 includes multiple user interface controls so that the user can activate and control the microprocessor of ornament 100. For example, menu button 240 is disposed on the rear surface of internal casing 210 to turn electronics of ornament 100 on and off or to access the menu screen. Universal serial bus ("USB") port 250 allows the user to download digital pictures to non-volatile memory within internal casing 210. A pair of scroll buttons 260 (one "up" and one "down" button) allows the user to select pictures and also to select and scroll through features on the menu screen. A power port 270 is provided so that an external power source can be coupled to ornament 100. Reset button 280 allows the user to clear the non-volatile memory of downloaded digital pictures.

Figure 3:
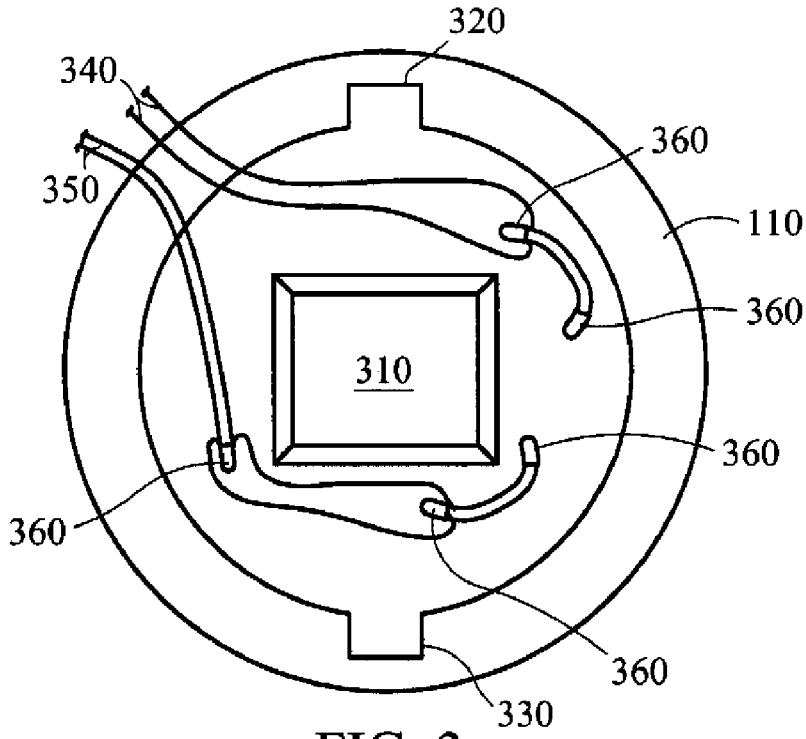
FIG. 3 is a rear view of the exterior housing of the digital picture display ornament in accordance with an embodiment of the present invention.

Referring now to FIG. 3 shows a rear view of exterior housing 110 with internal casing 210 removed so that the rear surface of the front face 120 can be seen. A rectangular boss 310 disposed concentrically on the rear surface of front face 120 secures LCD screen 130. A leg stand aperture 330 is formed in the sidewall of exterior housing 110 so that the first end of leg stand 230 fits snugly therein when stand 230 is in a stored position. As discussed above, an upper aperture 320 is formed in the sidewall of exterior housing 110 for receiving rounded protrusion 210 therein so that it is not visible from the front view of exterior housing 110.

A plurality of primary light emitting diodes ("LED") 360 are disposed on the rear surface of transparent front face 120. The primary LEDs 360 are disposed and orientated such that when illuminated, primary LEDs 360 illuminate and are visible through the transparent front face 120. Primary LEDs 360 can be any desired color but are preferably white light. The front face 120 is adapted to receive a decorative sheet of similar size and shape of front face 120. The user selected decorative sheet includes a design so that primary LEDs 360 illuminate strategically placed graphic elements. The decorative sheet does not allow light to pass through any place other than at the illumination of the LED. For example, in one embodiment the decorative sheet may have graphic elements that appear to be Christmas lights. Accordingly, when primary LEDs 360 are illuminated, it appears that the Christmas light graphic elements of the decorative sheet are illuminated.

Figure 4:
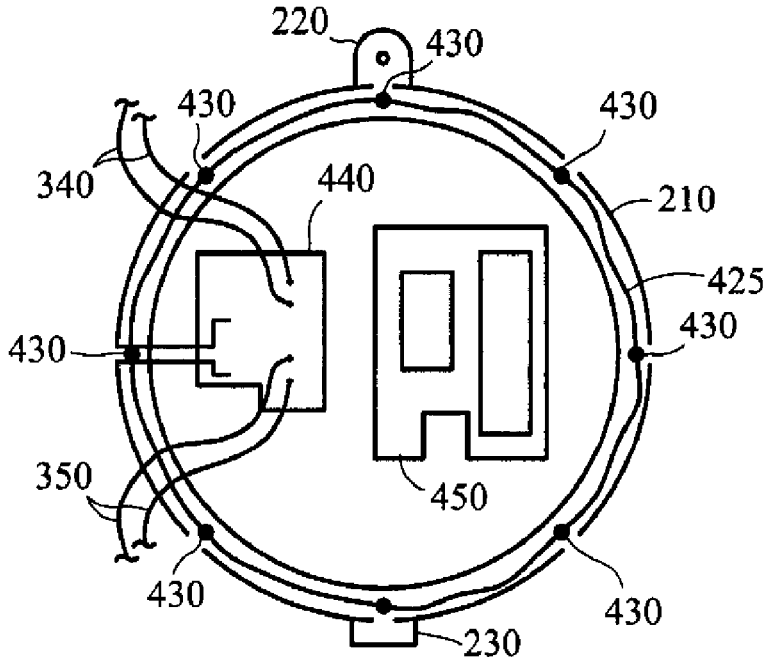
FIG. 4 is a top view of the internal casing of digital picture display ornament with the cover removed showing the electrical elements therein.

As shown in FIG. 4, primary LEDs 360 are in electrical communication with circuitry 440 and microprocessor 450 that controls turning primary LEDs 360 off and on. A first set of wiring 340 and second set of wiring 350 provide electrical communication between primary LEDs 360 mounted on face plate 120 that illuminate the graphic elements of the decorative sheet and circuitry 440 mounted within internal casing 210.

The internal casing 210 includes a pair of concentric sidewalls wherein a plurality of secondary LEDs 430 are housed therein. The internal casing has a plurality of LED notches disposed in the outer sidewall of the pair of concentric sidewalls for receiving the secondary LEDs. The outer sidewall of the internal casing 210 slides adjacent to the sidewall of external housing 110, which is transparent as discussed above. Accordingly, when the secondary LEDs 430 are illuminated, light is reflected outwards from internal casing 210 and passes through the transparent sidewall of the exterior housing 110 and is visible to the user. Secondary LEDs 430 can be any desired color but are preferably multi colored.

Secondary LEDs 430 are in electrical communication with microprocessor 440 that controls turning secondary LEDs 430 on and off. Microprocessor 440 also controls LCD screen 130 for displaying and accessing digital photographs from memory of ornament 100.

In one embodiment, a power source is provided to ornament 100 by standard AC power. In another embodiment, an internal power supply, such as a battery, is provided. In yet another embodiment, plugging into a string of Christmas tree lights provides the power source for ornament 100.

Figure 5:
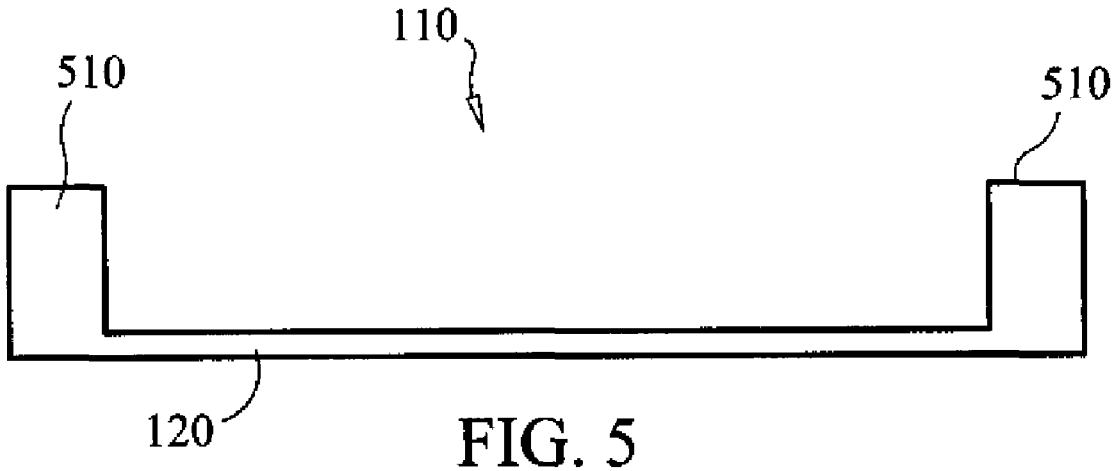
FIG. 5 is a cross sectional view of the exterior housing of the digital picture display ornament in accordance with an embodiment of the present invention.

Referring now to FIG. 5, a cross sectional view of exterior housing 110 is shown where sidewall 510 extends from front face 120 to form a void for receiving internal casing 210. In the preferred embodiment, sidewall 510 is a solid transparent plastic material. In an alternative embodiment, sidewall 510 is comprised of a translucent material. In another alternative embodiment, sidewall 510 is not a solid material but is filled with fluid to enhance the illumination from secondary LEDs 430 and to act as a heat exchanger to cool the circuitry housed within internal casing 210.

Figure 6:
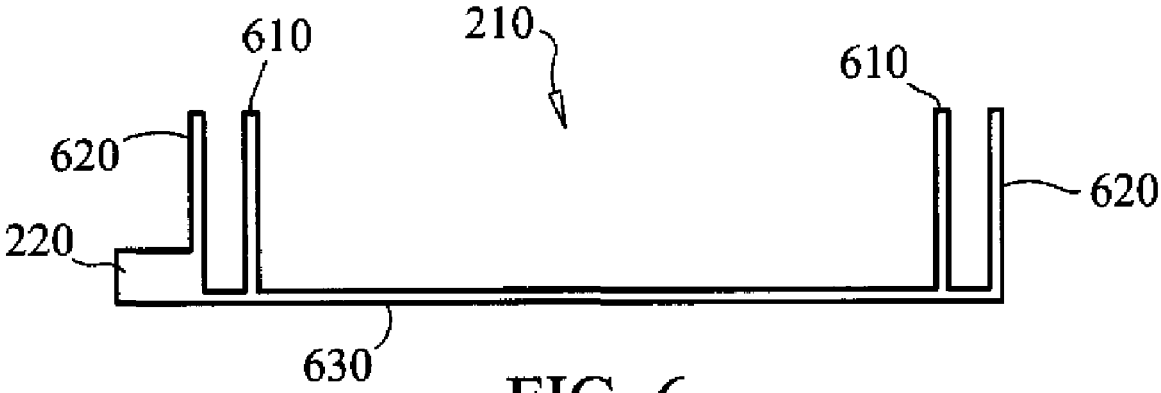
FIG. 6 is a cross sectional view of the internal casing of the digital picture display ornament shown without the electrical elements for clarity.

As shown in FIG. 6, outer sidewall 620 of internal casing 210 is concentric with inner sidewall 610 forming a narrow channel therebetween. Secondary LEDs 430 are placed within the channel of internal casing 210 so that a glowing illumination is projected from ornament 100. Microprocessor 440 and associated circuitry is mounted to base 630 of internal casing 210.

Decorative sheet 710 is secured to front face 120 of ornament 100. Graphic elements 730 are in the form and appearance of Christmas tree lights. Accordingly, as primary LEDs 360 are illuminated, graphic elements 730 glow from underneath providing an appearance that graphic elements 730 are illuminated. Accordingly, as digital pictures are displayed on LCD screen 130, graphic elements are illuminated by primary LEDs 360 providing a desirable frame for the pictures. Moreover, secondary LEDs 430 illuminate the periphery of ornament 100 providing a lighting effect that ornament 100 is glowing. Decorative sheet 710 may have the appearance and graphic elements related to a specific holiday or time of year, for example, Thanksgiving or summer, so that the present invention is not intended to be limited in scope by the example of decorative sheet 710 provided herein.

Figure 7:
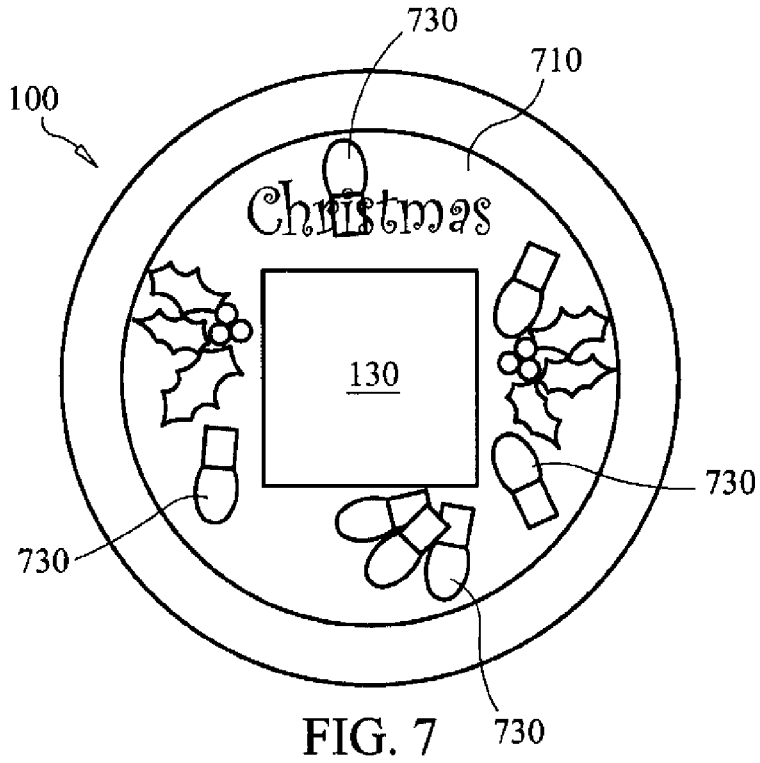
FIG. 7 is a front view of the digital picture display ornament with a decorative sheet applied to the front of exterior housing in accordance with an embodiment of the present invention.
Figure 8:
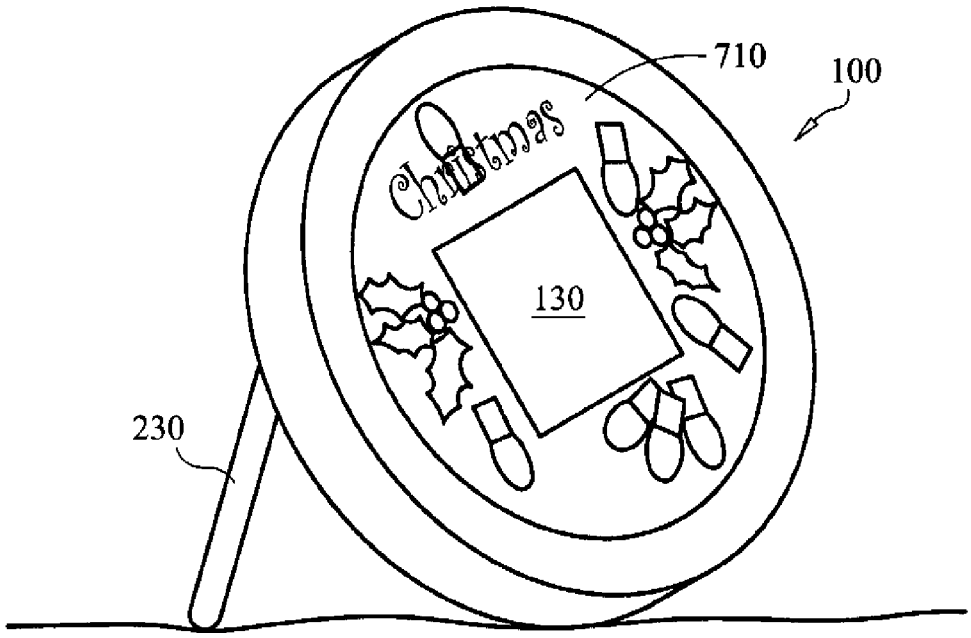
FIG. 8 is a perspective view showing the digital picture display ornament resting on a flat surface in accordance with an embodiment of the present invention.

Ornament 100 is adaptable to be hanging from a hook in a vertical position or supported at an angled position by leg stand 230 as shown in FIG. 7.

The particular embodiments disclosed above and in the drawings are illustrative only, as the invention may be modified and practiced in different but equivalent manners apparent to those skilled in the art having the benefit of the teachings herein. Furthermore, no limitations are intended to the details of construction or design herein shown. It is therefore evident that the particular embodiments disclosed above may be altered or modified and all such variations are considered within the scope and spirit of the invention.

It is also to be understood that the following claims are intended to cover all of the generic and specific features of the invention herein described, and all statements of the scope of the invention, which as a matter of language, might be said to fall there between.

Now that the invention has been described,

What is claimed is:

1. A digital picture display ornament comprising:

an exterior housing of a transparent material having a front circular face with an annular sidewall extending rearward from a periphery of the front circular face;

a plurality of primary light emitting diodes disposed on a rear surface of the front circular face of the exterior housing, wherein the primary light emitting diodes are disposed and orientated to illuminate graphic elements of a decorative sheet secured to a front surface of the front circular face of the exterior housing;

a liquid crystal display disposed on the rear surface of the front circular face of the exterior housing, wherein the liquid crystal display is in electrical communication with electronic circuitry housed within the ornament;

an opaque internal casing removably slipped snugly within the exterior housing with a friction fit; and a periphery of the internal casing comprising a pair of concentric sidewalls, wherein a plurality of secondary light emitting diodes are housed therein, wherein the internal casing having a plurality of notches disposed in an outer sidewall of the pair of concentric sidewalls for receiving the plurality of secondary light emitting diodes so that the plurality of secondary light emitting diodes illuminate outwards from the internal casing and produce a glow to the periphery of the ornament.

2. The digital picture display ornament of claim 1, wherein the rear surface of the front circular face of the exterior housing further comprising a rectangular boss disposed concentrically thereon to secure the liquid crystal display.

3. The digital picture display ornament of claim 1, wherein the internal casing further comprising a microprocessor to control functions of the ornament.

4. The digital picture display ornament of claim 1, wherein the internal casing further comprising non-volatile memory that stores digital images for viewing on the liquid crystal display.

5. The digital picture display ornament of claim 3, wherein a rear surface of the internal casing comprising a plurality of user interface controls so that a user can activate and control the microprocessor of the ornament.

6. The digital picture display ornament of claim 1, wherein the ornament is in electrical communication with a power source comprising a string of lights.

7. The digital display ornament of claim 1, wherein the transparent material of the exterior housing is polyethylene.

8. The digital display ornament of claim 1, wherein the internal casing further comprising a rounded protrusion disposed at a top portion of the internal casing so that the ornament is adaptable to being suspended from a nail or tree limb.

9. The digital display ornament of claim 8, wherein the annular sidewall of the exterior housing further comprising a first reciprocal aperture orientated to receive the rounded protrusion of the internal casing so that the exterior housing has a smooth appearance along its periphery.

10. The digital display ornament of claim 1, further comprising a retractable leg stand pivotally mounted to a rear surface of the internal casing, wherein the leg stand having a first end that swings outwardly from a stored position to an angled position to support the ornament in an upright position on a flat surface.

11. The digital display ornament of claim 10, further comprising a second reciprocal aperture orientated to receive the first end of the leg stand when the leg stand is in the stored position.

12. The digital picture display ornament of claim 1, further comprising an internal power source.

13. The digital picture display ornament of claim 1, wherein the plurality of primary light emitting diodes are white.

14. The digital picture display ornament of claim 1, wherein the plurality of secondary light emitting diodes are multi colored.

15. The digital picture display ornament of claim 1, wherein the annular sidewall of the exterior housing is filled with fluid.

16. A digital picture display ornament comprising:

an exterior housing of a transparent material having a front circular face with an annular sidewall extending rearward from a periphery of the front circular face, wherein a rear surface of the front circular face further comprising a rectangular boss disposed concentrically thereon to secure a liquid crystal display;

a plurality of primary light emitting diodes disposed on the rear surface of the front circular face of the exterior housing, wherein the plurality of primary light emitting diodes are disposed and orientated to illuminate graphic elements of a decorative sheet secured to a front surface of the front circular face of the exterior housing;

an opaque internal casing removably slipped snugly within the exterior housing with a friction fit, wherein the internal casing further comprising a microprocessor to control functions of the ornament and a non-volatile memory that stores digital images for viewing on the liquid crystal display;

a periphery of the internal casing comprising a pair of concentric sidewalls, wherein a plurality of secondary light emitting diodes are housed therein, wherein the internal casing having a plurality of notches disposed in an outer sidewall of the pair of concentric sidewalls for receiving the plurality of secondary light emitting diodes so that the plurality of secondary light emitting diodes illuminate outwards from the internal casing and produce a glow to a periphery of the ornament;

a retractable leg stand pivotally mounted to a rear surface of the internal casing, wherein the leg stand having a first end that swings outwardly from a stored position to an angled position to support the ornament in an upright position on a flat surface; and the internal casing further comprising a rounded protrusion disposed at a top portion of the internal casing so that the ornament is adaptable to being suspended from a nail or tree limb.

17. The digital picture display ornament of claim 16, wherein the rear surface of the internal casing comprising a plurality of user interface controls so that a user can activate and control the microprocessor of the ornament.

18. The digital picture display ornament of claim 16, wherein the ornament is in electrical communication with a power source comprising a string of lights.

19. The digital display ornament of claim 16, wherein the transparent material of the exterior housing is polyethylene.

20. A digital picture display ornament comprising:

an exterior housing of a transparent polyethylene material having a front circular face with an annular sidewall extending rearward from a periphery of the front circular face, wherein a rear surface of the front circular face further comprising a rectangular boss disposed concentrically thereon to secure a liquid crystal display;

a plurality of primary light emitting diodes disposed on the rear surface of the front circular face of the exterior housing, wherein the plurality of primary light emitting diodes are disposed and orientated to illuminate graphic elements of a decorative sheet secured to a front surface of the front circular face of the exterior housing;

an opaque internal casing removably slipped snugly within the exterior housing with a friction fit, wherein the internal casing further comprising a microprocessor to control functions of the ornament and a non-volatile memory that stores digital images for viewing on the liquid crystal display;

a periphery of the internal casing comprising a pair of concentric sidewalls, wherein a plurality of secondary light emitting diodes are housed therein, wherein the internal casing having a plurality of notches disposed in an outer sidewall of the pair of concentric sidewalls for receiving the plurality of secondary light emitting diodes so that the plurality of secondary light emitting diodes illuminate outwards from the internal casing and produce a glow to a periphery of the ornament;

a retractable leg stand pivotally mounted to a rear surface of the internal casing, wherein the leg stand having a first end that swings outwardly from a stored position to an angled position to support the ornament in an upright position on a flat surface; wherein the annular sidewall of the exterior housing further comprising a first reciprocal aperture orientated to receive the first end of the leg stand when the leg stand is in the stored position;

the internal casing further comprising a rounded protrusion disposed at a top portion of the internal casing so that the ornament is adaptable to being suspended from a nail or tree limb; wherein the annular sidewall of the exterior housing further comprising a second reciprocal aperture orientated to receive the rounded protrusion of the internal casing so that the exterior casing has a smooth appearance along its periphery; and a rear surface of the internal casing comprising a plurality of user interface controls so that a user can activate and control the microprocessor of the ornament.

* * * * *